US012454952B2

(12) United States Patent
Hewitt

(10) Patent No.: US 12,454,952 B2
(45) Date of Patent: Oct. 28, 2025

(54) HYDRAULIC PUMP ARRANGEMENT

(71) Applicant: J. C. Bamford Excavators Limited, Uttoxeter (GB)

(72) Inventor: James Hewitt, Uttoxeter (GB)

(73) Assignee: J. C. Bamford Excavators Limited, Uttoxeter (GB)

( * ) Notice: Subject to any disclaimer, the term of this patent is extended or adjusted under 35 U.S.C. 154(b) by 0 days.

(21) Appl. No.: 18/648,470

(22) Filed: Apr. 28, 2024

(65) Prior Publication Data

US 2024/0360828 A1 Oct. 31, 2024

(30) Foreign Application Priority Data

Apr. 27, 2023 (GB) ..... 2306254

(51) Int. Cl.
*F04B 53/18* (2006.01)
*F04B 9/02* (2006.01)
*F04B 17/03* (2006.01)

(52) U.S. Cl.
CPC ..... *F04B 53/18* (2013.01); *F04B 9/02* (2013.01); *F04B 17/03* (2013.01)

(58) Field of Classification Search
CPC ..... F04B 17/03; F04B 23/02; F04B 53/18; F04B 9/02; F04B 23/023; E02F 9/226; F16D 2001/103; F16D 2300/06; F16D 1/10; F16H 53/00; F15B 1/26; F15B 15/18; F04C 15/0061; F04C 15/0088
USPC ..... 184/6
See application file for complete search history.

(56) References Cited

U.S. PATENT DOCUMENTS 4,065,235 A * 12/1977 Furlong ..... F04C 15/0019 417/310
4,470,776 A * 9/1984 Kostek ..... F04C 15/0088 418/102
4,548,557 A * 10/1985 Janczak ..... F04C 11/00 418/206.7
5,076,770 A * 12/1991 Dabling ..... F04C 2/088 418/102
6,692,244 B2 * 2/2004 Bhagavatula ..... F04C 15/0046 418/206.7

(Continued)

FOREIGN PATENT DOCUMENTS

EP 2213804 A2 8/2010
GB 2604609 A 9/2022
JP H1-277691 A 11/1989

OTHER PUBLICATIONS

Search and Examination Report issued in GB 2306254.0, dated Oct. 9, 2023.

(Continued)

*Primary Examiner* — Henry Y Liu
(74) *Attorney, Agent, or Firm* — MARSHALL, GERSTEIN & BORUN LLP

(57) ABSTRACT

A hydraulic pump assembly includes an electric motor; a hydraulic pump driveably connected to the electric motor via a rotatable coupling; wherein the rotatable coupling includes a splined connection housed within a chamber comprising a chamber wall, wherein the chamber defines a flow passage for hydraulic oil for lubricating the rotatable coupling, the chamber includes an inlet for receiving a flow of hydraulic oil from the pump and an outlet for exiting the flow of hydraulic oil to the exterior of the chamber.

20 Claims, 2 Drawing Sheets

(56) References Cited

U.S. PATENT DOCUMENTS 6,716,011 B2 * 4/2004 Bhagavatula ..... F04C 15/0046 418/206.1
7,806,673 B2 * 10/2010 Muscarella ..... F04C 15/0088 418/206.8
8,708,678 B2 * 4/2014 Muscarella ..... F04C 15/0069 418/206.7
9,045,879 B2 * 6/2015 Watanabe ..... E02F 9/0891
9,863,419 B2 * 1/2018 Charwot ..... F04C 2/14
12,180,961 B2 * 12/2024 Kalidindi ..... F04C 29/0007
2003/0194342 A1 * 10/2003 Bhagavatula ..... F04C 15/0046 418/206.1
2006/0024188 A1 * 2/2006 Muscarella ..... F04C 15/0088 418/206.1
2010/0233007 A1 * 9/2010 Muscarella ..... F04C 15/0069 418/206.7
2013/0133962 A1 * 5/2013 Watanabe ..... E02F 9/0866 180/65.26
2016/0238004 A1 * 8/2016 Charwot ..... F04C 2/18
2022/0128052 A1 * 4/2022 Zhang ..... F04C 15/0061
2022/0282718 A1 9/2022 Hewett et al.
2023/0110432 A1 * 4/2023 Laforce ..... F16H 57/029 310/54
2023/0383748 A1 * 11/2023 Zhang ..... F04B 53/08
2024/0410402 A1 * 12/2024 Zhang ..... F15B 13/0401

OTHER PUBLICATIONS

Extended European Search Report issued in EP 24171972.3, dated Aug. 9, 2024.

* cited by examiner

HYDRAULIC PUMP ARRANGEMENT

FIELD

The present invention relates to the lubrication of a rotatable coupling in a hydraulic pump assembly comprising a motor and a hydraulic pump.

BACKGROUND

Working vehicles such as excavators, backhoe loaders, telehandlers, skid-steer loaders, dumpers and the like often have one or more hydraulically actuated devices such as working arm actuators, track motors, bucket actuators etc. Such hydraulically actuated devices operate by receiving a flow of hydraulic fluid from a hydraulic pump.

Typically, the hydraulic pump of a working vehicle receives hydraulic fluid from a reservoir, e.g. a hydraulic tank, via a first pipe and supplies hydraulic fluid to a hydraulic system via a second pipe, sometimes referred to as the pressure line. Following use in the hydraulic system, hydraulic fluid is returned to the reservoir via third line, sometimes called the tank line.

GB2604609 discloses a hydraulic pump system for a working vehicle including a housing defining a hydraulic fluid tank and a plurality of pump modules mounted to the tank. Each pump module includes a hydraulic pump for supplying hydraulic fluid from the tank to a hydraulic system and an electric motor for driving the pump. The electric motor is mounted on the exterior of the hydraulic fluid tank with the pump suspended below and at least partially submerged in the hydraulic fluid. The electric motor and hydraulic pump are connected by a common shaft.

Generally, the connection between an electric motor and a driven device, e.g. a hydraulic pump, is provided via a rotatable coupling such as a splined shaft (male/female, female/female with a splined connector, or a male/male with a splined coupling sleeve), a rectangular tang such as an Oldham coupling, or a keyed shaft.

Such direct mated couplings require greased lubrication, typically achieved with a one-time application during assembly. However, electrically driven hydraulic pumps for hydraulic services on working vehicles have a highly variable duty cycle with rapid acceleration and decelerations. This puts increased levels of stress on the contacting interfaces of the rotatable coupling and can lead to the grease being pushed out. This is particularly so when drive arrangement is vertically orientated and the grease can flow out of the coupling under gravity.

Alternatives to lubricated couplings include torsional flexible couplings, such as a KTR Rotex spider coupling, which are dry running and can accommodate torsional vibrations. However, flexible couplings are significantly more expensive, wear out after extended periods of use, and require alignment of components on assembly and additional housing to accommodate the components making the overall assembly larger.

The present invention seeks to provide an improved hydraulic pump assembly.

SUMMARY

The present invention provides a hydraulic pump assembly, a working machine incorporating the hydraulic pump assembly and a method of lubricating a rotatable coupling according to the appended claims.

The present disclosure provides a hydraulic pump assembly comprising: an electric motor; a hydraulic pump driveably connected to the electric motor via a rotatable coupling; wherein the rotatable coupling comprises a connection housed within a chamber comprising a chamber wall, wherein the chamber defines a flow passage for hydraulic oil for lubricating the rotatable coupling, the chamber comprising an inlet for receiving a flow of hydraulic oil from the pump and an outlet for exiting the flow of hydraulic oil to the exterior of the chamber.

Providing a flow of hydraulic oil from the pump of the pump assembly to a rotatable coupling allows the coupling to be continuously lubricated during use.

The rotatable coupling may comprise a splined connection. The flow of lubricating hydraulic oil may comprise leakage oil from the pump.

The rotatable coupling may comprise a first axial end proximate the pump and a second axial end proximate the electric motor, wherein the inlet is provided towards the first axial end and the outlet is provided towards the second axial end such that the flow passage extends along the rotatable coupling between the first and second axial ends.

Providing a flow of hydraulic oil from an inlet which is proximate the pump to an outlet proximate the electric motor allows for an axial flow of hydraulic oil from the pump along the coupling.

The flow passage may circumferentially envelope the hydraulic coupling. Providing the flow passage around the hydraulic coupling allows the coupling to be continually bathed in hydraulic oil, thereby increasing the flow of oil into the splined connection.

The rotatable coupling may comprise an axis of rotation. The axis of rotation may be vertically orientated in use. The inlet may be located vertically below the outlet when in use. The pump may be located vertically below the electric motor when in use. For example, where the electric motor is mounted to an upper wall of a hydraulic tank in which the pump is located. In such an arrangement, the oil may be pumped up from the pump towards the electric motor via the inlet.

The chamber wall may be cylindrical. The chamber wall may be coaxial with the rotatable coupling.

The chamber may comprise a chamber wall. The chamber wall may be cylindrical and provide a housing which extends circumferentially around and axially along the rotatable coupling. The cylindrical wall may extend from either or both of a motor housing or pump housing. The chamber may be externally sealed save for the outlet. That is, the inlet may be located within the chamber with the flow being introduced from within the pump.

The outlet may be an aperture in the chamber wall configured to provide an overflow drain for oil within the chamber. The aperture may be a single aperture or one of plurality of circumferentially distributed apertures. The aperture may comprise a through-hole through a chamber wall. The aperture may directly connect the interior of the chamber with the interior of a hydraulic tank and oil storage area within the hydraulic tank.

An aperture in the chamber wall from which the oil can drain provides a simple way of returning the lubricating oil flow back to the storage area of the hydraulic oil tank. This is particularly advantageous when the oil flow is pushed along the flow passage from the pump and along the rotatable coupling. In some embodiments, the aperture may be connected to a conduit to transport the exiting flow of hydraulic oil to a different location. This may be advantageous when, for example, the pump assembly is not tank mounted but instead connected to a hydraulic tank via one or more hydraulic lines.

The aperture may define a fill level of the lubricating hydraulic oil within the chamber. That is, the aperture may act as an overview for hydraulic oil within the chamber. The aperture may be located axially adjacent a second end of the splined coupling. Thus, when the rotatable coupling is vertically orientated with a vertical axis of rotation, the outlet may be horizontally aligned or above a second (distal) end of the contacting surfaces of the splined connection. This may result in the outlet being located at a common height or above the distal end of the pump shaft.

The splined connection may comprise an inter engagement of longitudinal axially extending ribs which are arranged circumferentially around the axis of rotation of the rotating coupling.

The pump may comprise: a pump shaft connected to the rotatable coupling and a pump shaft bearing, wherein the inlet is in fluid communication with the pump shaft bearing and configured to receive a flow of hydraulic oil therefrom.

The bearings of the pump may be advantageously provided with a flow of hydraulic oil for lubrication purposes. The flow of hydraulic oil may be leakage oil which extends past one or more pumping elements (e.g. a piston) of the hydraulic pump. Extending this lubricating flow to the rotatable coupling provides a convenient way of lubricating the rotatable coupling.

The pump and electric motor may be structurally connected via the chamber wall. The pump and electric motor may be structurally connected by a threaded engagement in the chamber wall. The chamber wall may be provided by the electric motor and/or the pump. The electric motor may comprise a cylindrical wall which extends from the motor housing to define a housing for electric motor shaft which forms part of the coupling. The pump may comprise a cylindrical wall which extends from the pump housing to define a housing for the pump shaft which forms part of the coupling. The cylindrical wall of the pump may comprise one or more shaft bearings.

The cylindrical wall of either the pump or motor may terminate in a threaded portion which receives a corresponding threaded portion of the other of the motor or pump to provide a threaded engagement. The threaded engagement may be configured to seal the chamber to prevent oil leakage therefrom. The pump may be suspended below the electric motor by the threaded engagement.

The electric motor may comprise a motor shaft which extends into the chamber, the motor shaft may comprise an oil seal to prevent oil entering the motor housing.

The motor drive shaft may comprise a female shaft spline and the pump comprises a male shaft spline.

Providing the motor with a female spline allows the bottom of the spline connection to be open for receiving a flow of oil from the flow passage.

The hydraulic pump assembly may further comprise a hydraulic tank having an oil storage area. The hydraulic pump may be located within the oil storage area and may comprise at least one pump inlet for drawing a flow of hydraulic oil therefrom.

The rotatable coupling may be located vertically within the hydraulic tank, optionally above the oil storage area.

The outlet may be in fluid communication with an area above the oil storage area such that hydraulic fluid which exits the outlet can flow under gravity into the oil storage area.

The oil storage area may be defined by a fill level line. The outlet may be positioned above the fill level line.

The oil fill line may be provided by a physical indicator on a wall of the hydraulic tank which is viewable by a user. The physical indicator may comprise a window in a wall of the hydraulic tank, for example. The window may be positioned and sized or marked to provide an indication to an operator as to whether there is sufficient oil.

The hydraulic tank may comprise a housing having a base, a side wall and an upper wall, wherein a motor housing of the electric motor is located above the upper wall and a motor drive shaft and a portion of the chamber wall extend from the motor through the upper wall.

The outlet, e.g. an aperture in the chamber wall, may be provided in the motor housing or the motor housing chamber wall portion. The hydraulic tank may comprise a return line inlet through which hydraulic oil is returned to the tank from the hydraulic services of the working machine. The return line inlet may comprise an opening located in the wall of the hydraulic tank. The return line inlet may be located below the oil fill line. The return line inlet may be provided below the outlet.

The rotatable coupling may comprise the pump drive shaft and the motor drive shaft.

The present disclosure provides a working machine comprising a hydraulic pump assembly as disclosed herein.

The present disclosure provides a method of lubricating a rotatable coupling between a motor and a hydraulic pump, wherein the rotatable coupling comprises a splined connection housed within a chamber comprising a chamber wall, wherein the chamber defines a flow passage for hydraulic oil for lubricating the rotatable coupling, the chamber comprising an inlet for receiving a flow of hydraulic oil from the pump and an outlet for exiting the flow of hydraulic oil to the exterior of the chamber, the method comprising: pumping hydraulic oil through the inlet into the chamber and out of the outlet using the pump.

The inlet may be in fluid communication with pump shaft bearing arrangement and pumping the hydraulic oil though the inlet comprises pumping the oil through the bearings upstream of the inlet.

The pump may be suspended below the motor and the outlet comprises an aperture in a chamber wall.

The skilled person will appreciate that except where mutually exclusive, a feature described in relation to any one of the aspects, embodiments or examples described herein may be applied mutatis mutandis to any other aspect, embodiment or example. Furthermore, except where mutually exclusive, any feature described herein may be applied to any aspect and/or combined with any other feature described herein.

BRIEF DESCRIPTION OF DRAWINGS

Embodiments will now be described by way of example only with reference to the accompanying figures, in which.

DETAILED DESCRIPTION

In the following detailed description, numerous specific details are set forth in order to provide a thorough understanding of various embodiments and the inventive concept.

However, those skilled in the art will understand that: the present invention may be practiced without these specific details or with known equivalents of these specific details; that the present invention is not limited to the described embodiments; and, that the present invention may be practiced in a variety of alternative embodiments. It will also be appreciated that well known methods, procedures, components, and systems may have not been described in detail.

In the following description, reference to the terms "axial" and "radial" may be taken to be in relation to the rotational axis of the rotatable coupling unless otherwise stated. The term "vertical" may be taken be the preferred orientation of the hydraulic pump assembly in normal use. For example, in the illustrated embodiment of the hydraulic pump assembly for a hydraulic system of a working vehicle, the term "vertical" may be used in relation to the working vehicle when on horizontal flat ground and may be parallel to, for example, a slew axis of the working vehicle or a king post, or orthogonal to a horizontal pivot axis of a lifting of a telehandler or working arm of an excavator, for example.

Figure 1:
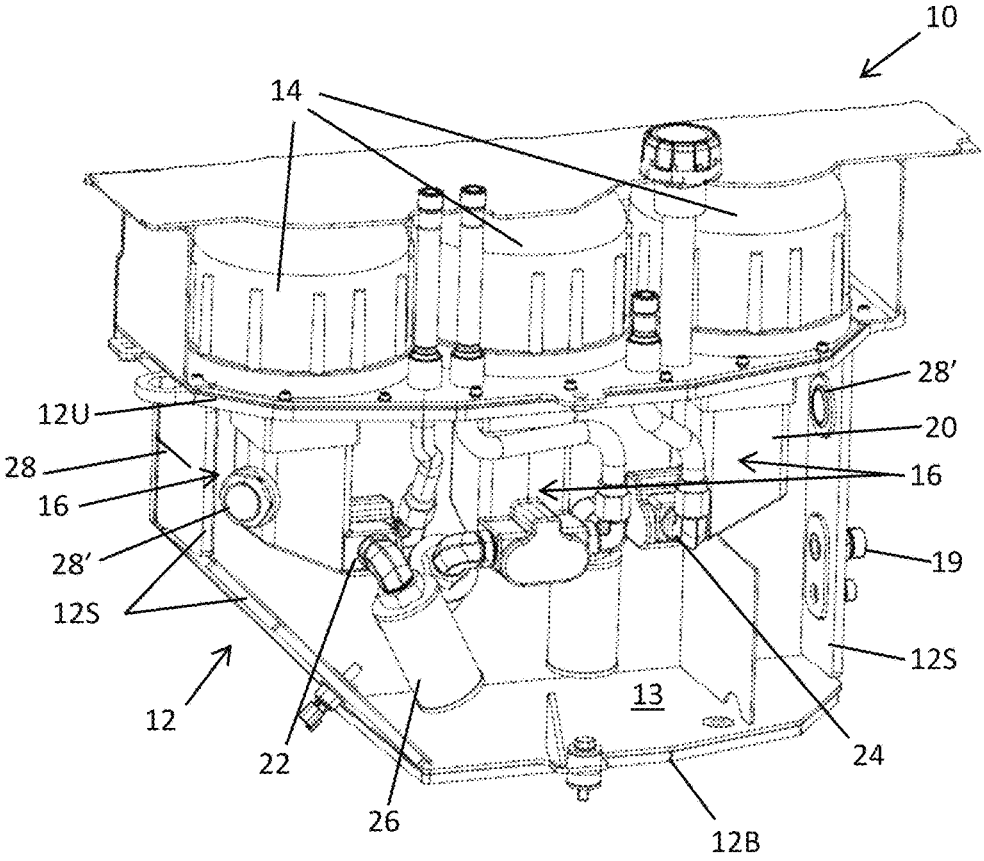
FIG. 1 shows a hydraulic pump assembly according to the present disclosure.
Figure 2:
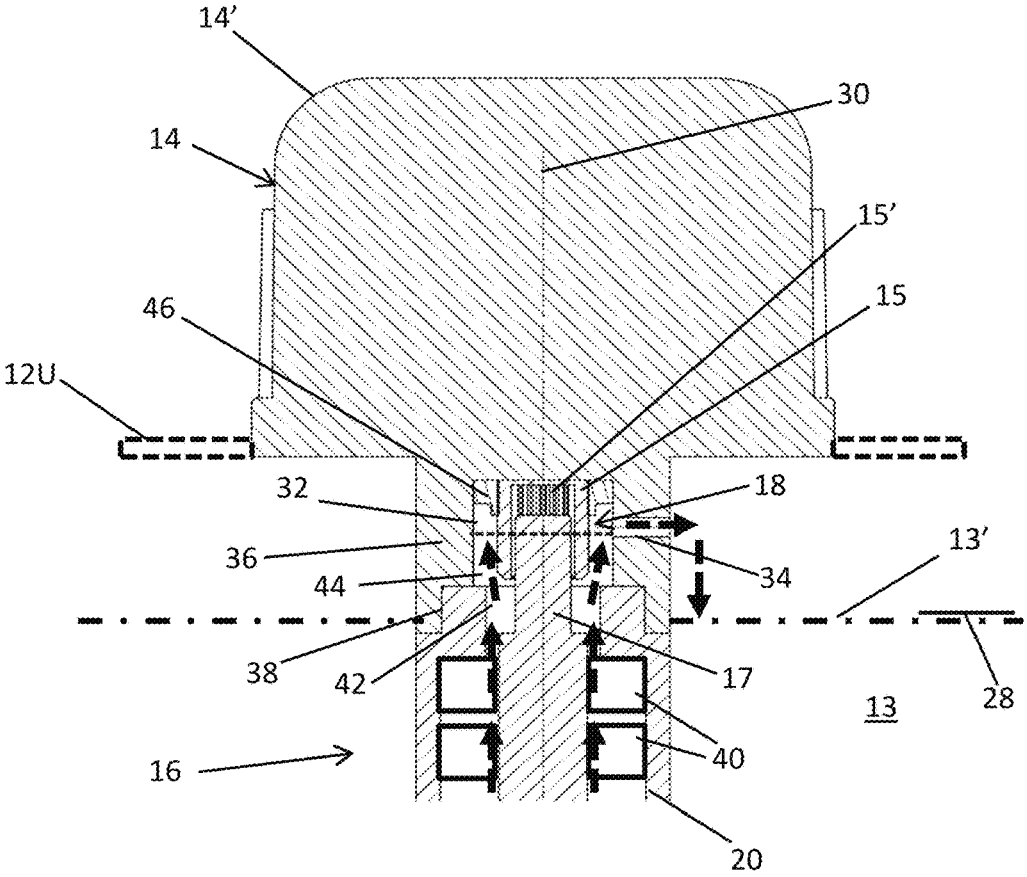
FIG. 2 shows a section of an electric motor and hydraulic pump which are linked by a rotatable coupling; and, FIG. 3 shows a working machine.
Figure 3:
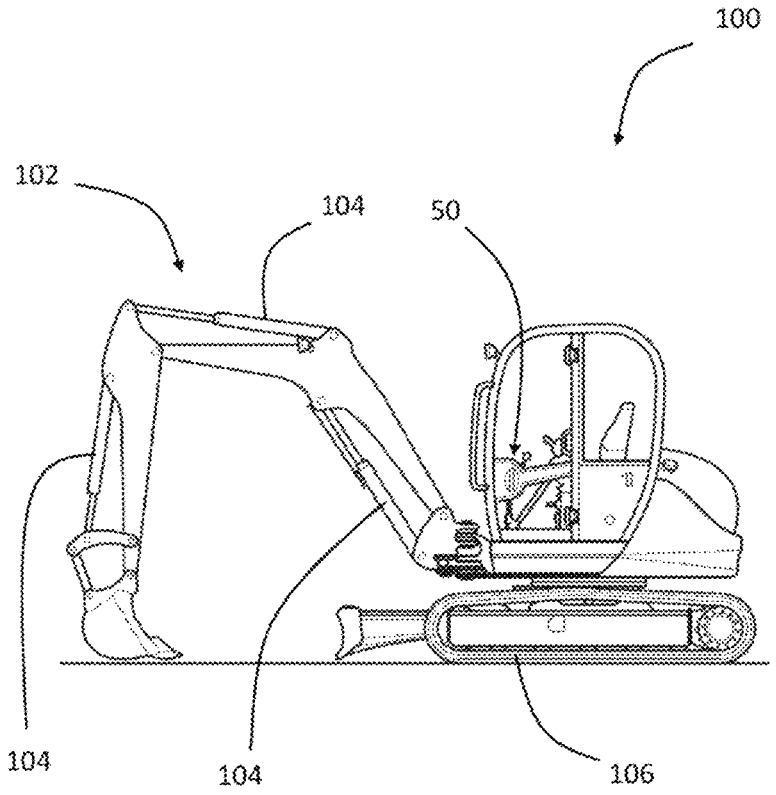

FIGS. 1 and 2 show a hydraulic pump arrangement 10 according to the present disclosure. The hydraulic pump arrangement 10 comprises a hydraulic tank 12 (shown in section) having a plurality of electric motors 14 mounted thereto, each driveably coupled to a hydraulic pump 16. The electric motor 14 and hydraulic pump 16 pairs are connected via a rotatable coupling 18 such that rotation of the electric motor 14 causes rotation of the pump 16, e.g. a rotation of an impeller or a crank to drive pump pistons. The pumps 16 are housed inside the tank 12 so as to be submerged within hydraulic fluid (not shown), whereas the motors 14 are provided on the exterior of the tank 12. In the illustrated embodiment, the electric motors 14 are provided above an upper wall 12U of the hydraulic tank 12 with the pump suspended below. A drive shaft 15 of the motor forms part of the rotatable coupling 18 and extends from the motor 14 into the tank 12 such that the rotatable coupling 18 is inside the tank 12 but above an oil storage area/a hydraulic fluid fill level 13'.

The pumps 16 may be generally conventional and include some form of pumping element, such as an impeller (not shown) or piston, within a housing 20, a hydraulic fluid intake/pump inlet 22 and a hydraulic fluid outlet 24. The inlet 22 is configured to draw hydraulic fluid from within the tank 12 and may comprise a filter 26 (which may be referred to as a suction strainer). The pump outlet 24 may be connected to one or more hydraulic services on the working vehicle 100 via a conventional valve arrangement and one or more pressure lines (not shown). A tank line 19 for returning flow may be attached to the side of the tank 12, as well known in the art.

The hydraulic tank 12 is generally provided by a housing comprising plurality of walls which combine to define an oil storage area 13 in which hydraulic oil is held. The walls may include an upper 12U, a base wall 12B and one or more sidewalls 12S extending therebetween. The base wall 12B and upper wall 12U may be generally flat and horizontal with the sidewalls 12S extending vertically when the machine is on flat horizontal ground. It will be appreciated that the shape and size of the hydraulic tank may vary amongst different embodiments. The construction, materials and assembly of the hydraulic tank 12 may be conventional. For example, the tank 12 may be constructed from plastic or sheet metal as well known in the art.

As noted, the pumps 16 are located within the oil storage area 13 so as to be mostly submerged in hydraulic oil in normal use. The electric motors 14 are located outside of the hydraulic tank 12 on the exterior of the upper wall 12U and above the pumps 16. The level of the hydraulic fluid may vary in use due to changes in orientation of the machine and losses in the system, e.g. leaks etc., but can nominally be associated with a fill line 28 which represents a recommended fill level. It will be appreciated that the fill line 28 may represent an upper limit of a fill range comprising a maximum fill and a minimum fill. The fill line 28 may be provided by a mark or some other physical indicator provided on the side of the tank or with a fill window 28' through which an operator can determine whether there is sufficient hydraulic oil in the tank. It will be appreciated that other physical systems, such as a dipstick, or electronic systems comprises a float switch or the like, may be used in some embodiments.

The electric motors 14 may comprise a conventional stator and rotor arrangement located within a motor housing which sits on the exterior of the tank 12. A motor drive shaft 15 extends centrally from the motor housing 14' into the tank 12. Rotation of the rotor causes a corresponding rotation of the motor drive shaft 15. The motor 14 may be invertor driven, for example. Further details of the motor 14 construction, the invertor and invertor control are beyond this disclosure but may be understood to be generally conventional.

Referring to FIG. 2, there is shown a section of rotatable coupling 18 through which a pump 16 and a motor 14 pair is drivably connected. The rotatable coupling 18 may be any suitable connection which provides a direct drive and requires lubrication. The rotatable coupling 18 of the illustrated embodiment comprises corresponding female and male spline shafts of the motor 14 and pump 16 respectively which are axially mated and interengaged to provide a direct drive between the motor 14 and pump 16.

In the illustrated embodiment, the motor drive shaft 15 includes a female spline into which a male spline provided by a pump shaft 17 is received thereby rotationally coupling the motor 14 and pump 16 together. Providing the female shaft as the upper component in the rotatable coupling 18 provides an opening at the bottom of the engagement through which oil can flow in and out of spline interface to provide lubrication. Thus, in use, when the exterior of the rotatable coupling 18 is submerged in hydraulic oil, the oil can enter the spline and lubricate the interface therebetween. In other embodiments, it may be preferable to provide the female connection with the pump so that oil might be retained.

In the illustrated embodiment, the male and female splines may comprise a plurality of circumferentially distributed axial teeth 15' which extend parallel to the rotational axis 30 of the rotatable coupling 18 as well known in the art. As well as a male/female connection, the splined coupling may comprise a female/female connection with a splined intermediate male connector, or a male/male connection with a splined coupling sleeve. Other splined rotatable couplings may include a rectangular tang such as an Oldham coupling, or a keyed shaft. Generally, it will be appreciated that the rotatable coupling 18 may be connected by any known alternative spline arrangement which provides the rotational interlock and is capable of being beneficially lubricated by the disclosed flow passage arrangement.

The rotatable coupling 18 is provided within a chamber 32 which is configured to receive and channel a flow of hydraulic fluid (i.e. hydraulic oil) from the oil storage area of the hydraulic tank 12, around/through the rotatable coupling 18 and back to the hydraulic tank 12. The flow of hydraulic fluid is sufficient to provide continuous lubrication of the spline during use of the motor and pump.

In the illustrated embodiment the flow of oil enters the rotatable coupling chamber 32 from the hydraulic pump 16 and exits back to the oil reservoir 13 via an outlet provided by an aperture 34 in a chamber wall 36 of the chamber 32. The aperture 34 is positioned so as to be above the nominal hydraulic fluid level 13' such that the flow of hydraulic fluid may be returned under gravity. As such, when the chamber 32 is filled with oil under positive pressure created by the pump 16, the aperture 34 acts as an overflow drain to limit the oil level/pressure in the chamber 32 whilst providing a continuous flow past the coupling 18.

The position of the aperture 34 may be determined by a required fill level 13' within the chamber 32 relative to the size and position of the spline connection. The aperture 34 may be provided along the length of the rotatable coupling 18 between a first axial end proximal the pump 16, and a second axial end proximal the motor 14. In the illustrated embodiment, the aperture 34 is provided at approximately the same height as the upper end of the splined interface which, in the example shown, coincides with the end of the pump shaft 17. In other words, the aperture 34 is provided in approximate horizontal alignment with the end of the pump shaft 17.

The outlet may be provided by a single aperture 34 or by a plurality of apertures circumferentially distributed about the chamber wall 36. Where there is a distribution of apertures 34, they may be placed at a common height, or at different heights to provide increased outflow as the oil level within the chamber 34 increases.

The chamber wall 36 may extend from the underside of the motor 14 and may be considered to be an extension of the motor housing 14'. Additionally or alternatively, the chamber wall 36 may extend upwardly from the pump 16 and may be considered to be an extension of the pump housing 20, or a bearing chamber housing in which the pump shaft bearings 40 are housed.

In the illustrated embodiment, the chamber 32 is provided by a cylindrical wall 36 which extends circumferentially around the rotatable coupling 18 and is coaxial with the axis of rotation 30. Providing a cylindrical chamber wall 36 allows the flow passage 44 to be circumferentially uniform in cross-section. Thus, as shown in FIG. 2, the chamber wall 36 may extend from the base of the motor to surround the motor shaft 15 and provide an enclosure for the rotatable coupling 18, either fully or partially. The pump 16 additionally includes a corresponding extension which stops short of the splined interface of the rotatable coupling 18 and defines an inlet 42 for a flow of hydraulic oil past the bearings 40.

The respective walls of the rotatable coupling chamber may attach to one another in a conventional manner, for example, via a threaded engagement 38 or a clamp, to provide an internal cavity for the rotatable coupling 18 and flow of hydraulic fluid. The attachment of the motor 14 and pump 16 via the chamber wall may be sufficient to locate the pump beneath the motor without the need for further structural support. That is, the chamber wall provides a structural support between the motor and pump such that the pump is suspended below the motor. However, in other embodiments, in addition to the direct connection of the motor 14 and pump 16, either or both of the motor and pump may be attached to the tank or some other structural member to provide additional support.

In the illustrated embodiment, the motor 14 is attached to an upper wall of the tank housing 12U via a plate member whilst the pump 16 is suspended below. In an alternative arrangement the pump 16 may comprise one or more additional supporting members, e.g. one or more brackets or direct connections to the tank housing 12.

The motor drive shaft 15 extends from the motor housing through a seal 46 which rotatably receives the drive shaft 15 and seals against it to prevent oil ingress into the motor housing 14' and windings, for example.

With the exception of the inlet 42 and outlet 34, the chamber 32 may be substantially sealed such that hydraulic fluid may be driven into and retained within the chamber 32 under the influence of the pump 16 where it will flow out when at or above the height of the outlet 34.

As can be seen in FIG. 2, the pump shaft 17 is rotationally retained by one or more bearings 40 located in a bearing housing provided at the coupling end of the pump housing. It is known for pump shaft bearings to be lubricated by a flow of leakage oil which has passed the pumping element, e.g. one or more pistons, and entered the interior of the housing. Conventionally, this leakage oil is retained within the bearing chamber thereby removing the need for any flow path. In some examples, a check valve may be included to allow the bearing chamber to be filled when the system is initially used. In the pump arrangement of the present disclosure, bearing chamber may include an opening at the distal end thereof to allow oil to flow into the rotatable coupling chamber. Thus, an opening in the end of the bearing chamber may provide inlet 42 for the rotatable coupling chamber 32. The inlet 42 may be provided as a full annulus, or may comprise one or more apertures provided in an end wall of the bearing housing.

In use, the motor 14 may be operable to drive the hydraulic pump 16 in accordance with a desired duty cycle. A description of the specific duty cycle is beyond this disclosure but may be conventional for powering the hydraulic services or propulsion of a working vehicle. When the motor 14 and pump 16 are operating, the pump 16 provides a flow of oil through the pump bearings 40 and into the chamber 32 to lubricate the rotatable coupling 18. The flow passage (shown by the dashed line 44) extends to the outlet aperture 34 such that the flow of oil might return to the reserve of hydraulic oil provided in the oil storage area 13.

As noted, the hydraulic pump assembly 10 of the present disclosure may be of particular use in a working vehicle. Such a working vehicle is indicated at 100 in FIG. 2. The working vehicle 100 includes a working arm 102 controlled by a plurality of hydraulic actuators 104. The working vehicle 100 also includes a pair of left and right tracks 106 for moving the working vehicle 100. The left and right tracks 106 are driven by respective hydraulic motors. A set of user inputs 50 (e.g. joy-sticks, levers, buttons, pedals etc.) are provided on the working vehicle 100 for controlling movement of the working vehicle 100 and the working arm 102.

The working vehicle 100 also includes a hydraulic pump arrangement 10 as described above in relation to FIGS. 1 and 2 The hydraulic pump system 10, 210 is provided to supply hydraulic fluid 16 to the hydraulic actuators 104 and left/right track motors of the working vehicle 100. The hydraulic pump arrangement 10 with an integrally mounted motor and pump in the hydraulic tank are particularly compact and efficient. This provides significant benefits when applied to a working vehicle 100 (where space is restricted and power is of limited capacity), particularly when the working vehicle 100 is an electric working vehicle where increased efficiency results in increased battery life and periods of use between charging, or a fuel cell powered working vehicle where reduced energy losses result in reduced fuel consumption.

The inclusion of an lubrication system as disclosed herein provides an efficient an reliable way of ensuring that the splined connection between a motor and pump is well lubricated, which is particularly useful for the duty cycles of a working vehicle which may be irregular and generally demanding on a splined connection.

In the illustrated embodiment, the working vehicle 100 is of the type known as an excavator. In alternative embodiments, the working vehicle is a different type of vehicle. For example, in some embodiments the working vehicle is a backhoe loader, telehandler, skid-steer loader, dumper, fork-lift truck or other type of working vehicle having one or more hydraulically-actuated devices.

In alternative embodiments, the hydraulic pump arrangement 10 may be part of a hydraulic system of a static application rather than a mobile application such as a working vehicle (e.g. the hydraulic pump arrangement 10 may be part of an industrial hydraulic system in a manufacturing or processing plant).

In alternative embodiments, the hydraulic pump assembly may not be tank mounted. In such embodiments the motor and pump may be connected to a hydraulic tank via appropriate hydraulic lines. In such a case, the outlet of the rotatable coupling chamber may be connected to the tank using a separate line. Further, the separate hydraulic pump assemblies may be horizontally orientated.

The one or more embodiments are described above by way of example only and it will be appreciated that the variations are possible without departing from the scope of protection afforded by the appended claims.

The invention claimed is:

1. A hydraulic pump assembly comprising:

an electric motor;

a hydraulic pump driveably connected to the electric motor via a rotatable coupling;

wherein the rotatable coupling comprises a splined connection housed within a chamber comprising a chamber wall, wherein the chamber defines a flow passage for hydraulic oil for lubricating the rotatable coupling, the chamber comprising an inlet for receiving a flow of hydraulic oil from the pump and an outlet for exiting the flow of hydraulic oil to the exterior of the chamber, wherein the rotatable coupling comprises a first axial end proximate the pump and a second axial end proximate the electric motor, and wherein the inlet is provided towards the first axial end and the outlet is provided towards the second axial end such that the flow passage extends along the rotatable coupling between the first and second axial ends.

2. The hydraulic pump assembly of claim 1, wherein the flow passage circumferentially envelopes the hydraulic coupling.

3. The hydraulic pump assembly of claim 2, wherein the chamber wall is cylindrical and coaxial with the rotatable coupling.

4. The hydraulic pump assembly of claim 1, wherein the outlet is an aperture in the chamber wall configured to provide an overflow drain for oil within the chamber.

5. The hydraulic pump assembly of claim 1, wherein the pump comprises:

a pump shaft connected to the rotatable coupling and a pump shaft bearing, wherein the inlet is in fluid communication with the pump shaft bearing and configured to receive a flow of hydraulic oil therefrom.

6. The hydraulic pump assembly of claim 1, wherein the pump and electric motor are structurally connected via the chamber wall.

7. The hydraulic pump assembly of claim 6, wherein the pump and electric motor are structurally connected by a threaded engagement in the chamber wall.

8. The hydraulic pump assembly of claim 1, further comprising a hydraulic tank having an oil storage area, wherein the hydraulic pump is located within the oil storage area and comprises at least one pump inlet for drawing a flow of hydraulic oil therefrom.

9. The hydraulic pump assembly of claim 8, wherein the rotatable coupling is located vertically within the hydraulic tank.

10. The hydraulic pump assembly of claim 9, wherein the outlet is in fluid communication with an area above the oil storage area such that hydraulic fluid which exits the outlet can flow under gravity into the oil storage area.

11. The hydraulic pump assembly of claim 10, wherein the oil storage area is defined by a fill level line, wherein the outlet is positioned above the fill level line.

12. The hydraulic pump assembly of claim 8, wherein the hydraulic tank comprises a housing having a base, a side wall and an upper wall, wherein a motor housing of the electric motor is located above the upper wall and a motor drive shaft and a portion of the chamber wall extend from the motor through the upper wall.

13. The hydraulic pump assembly of claim 12, wherein the rotatable coupling comprises a pump drive shaft and the motor drive shaft.

14. A working machine comprising the hydraulic pump assembly of claim 1.

15. A hydraulic pump assembly, comprising:

an electric motor;

a hydraulic pump driveably connected to the electric motor via a rotatable coupling;

wherein the rotatable coupling comprises a splined connection housed within a chamber comprising a chamber wall, wherein the chamber defines a flow passage for hydraulic oil for lubricating the rotatable coupling, the chamber comprising an inlet for receiving a flow of hydraulic oil from the pump and an outlet for exiting the flow of hydraulic oil to the exterior of the chamber, and wherein the electric motor comprises a motor drive shaft which extends into the chamber, the motor drive shaft comprising an oil seal to prevent oil entering the motor housing.

16. The hydraulic pump assembly of claim 15, wherein the motor drive shaft comprises a female shaft spline and the pump comprises a male shaft spline.

17. A hydraulic pump assembly comprising:

a hydraulic tank;

an electric motor located above the hydraulic tank;

a hydraulic pump located vertically below and within the hydraulic tank, the hydraulic pump being driveably connected to the electric motor via a rotatable coupling;

wherein the rotatable coupling comprises:

a splined connection housed within a chamber comprising:

a chamber wall, wherein the chamber defines a flow passage for hydraulic oil for lubricating the rotatable coupling, an inlet for receiving a flow of hydraulic oil from the pump and an outlet for exiting the flow of hydraulic oil to the exterior of the chamber such that driving the hydraulic pump with the electric motor causes a flow of hydraulic fluid through the chamber.

18. The hydraulic pump assembly of claim 15, further comprising a hydraulic tank having an oil storage area, wherein the hydraulic pump is located within the oil storage area and comprises at least one pump inlet for drawing a flow of hydraulic oil therefrom.

19. The hydraulic pump assembly of claim 18, wherein the rotatable coupling is located vertically within the hydraulic tank.

20. The hydraulic pump assembly of claim 19, wherein the outlet is in fluid communication with an area above the oil storage area such that hydraulic fluid which exits the outlet can flow under gravity into the oil storage area.

* * * * *